United States Patent [19]

Brennecke

[11] 4,048,667

[45] Sept. 13, 1977

[54] DEVICE FOR DISCHARGING STATIC ELECTRICITY

[76] Inventor: Hermann Brennecke, Schwambstrasse 37, 61 Darmstadt, Germany

[21] Appl. No.: 713,237

[22] Filed: Aug. 10, 1976

[30] Foreign Application Priority Data

Aug. 13, 1975 Germany ..... 2536091

[51] Int. Cl.[2] ..... H05F 3/00

[52] U.S. Cl. ..... 361/213; 361/222

[58] Field of Search ..... 361/212, 213, 220, 222; 324/32, 109

[56] References Cited

U.S. PATENT DOCUMENTS

| | | | |
|---|---|---|---|
| 2,333,213 | 11/1943 | Slayter | 361/213 |
| 3,921,037 | 11/1975 | Testone | 361/222 |
| 3,968,405 | 7/1976 | Testone | 361/220 |

FOREIGN PATENT DOCUMENTS

| | | | |
|---|---|---|---|
| 1,930,465 | 8/1970 | Germany | 361/222 |
| 123,266 | 1/1959 | U.S.S.R. | 361/222 |

*Primary Examiner*—Gerald Goldberg
*Attorney, Agent, or Firm*—Craig & Antonelli

[57] ABSTRACT

A device to discharge substrates loaded with static electricity by means of an electric glow discharge generated between isolated high voltage electrodes and exposed needle electrodes connected to a grounded collector bar is characterized by the fact that the high voltage electrodes are formed as concentric closed rings conductively connected to each other and disposed in spaced coaxial relationship with the needle electrodes. The grounded collector bar is formed as a hollow chamber into which compressed air may be introduced and directed into the space between the ring electrodes and the needle electrodes associated therewith to perform a cleaning operation and aid in directing ions toward the substrate to be discharged.

15 Claims, 6 Drawing Figures

DEVICE FOR DISCHARGING STATIC ELECTRICITY

The invention consists of a device for discharging substrates loaded with static electricity by application thereto of an electric glow discharge which occurs between isolated high voltage electrodes on one side and unisolated needle electrodes connected to a gounded collector bar on the other side.

Such discharge devices, generally referred to as ionizers, are used for example to remove static electricity from sheets of paper, textiles or from substrates to be coated by an electrostatic coating process. To make the ionizers safe against contact, it has been for some time standard practice to surround the high voltage electrodes with an insulator, e.g., by casting them in plastic, so that only the grounded, and therefore safe, needle electrodes are exposed to contact. Such an ionizer was described for example in the Germal Patent DR-PS Nr. 1224 848. Unfortunately, by this solution one has to accept a certain negative influence on the electric field between the electrodes and a decrease of the ionization efficiency.

This invention has the general object of improving the efficiency of ionizers of the type described, mainly to increase their radiation intensity, without increasing their energy construction.

Another object of the present invention is to provide an ionizer which is economical to produce and has universal applicability.

These objects will be obtained according to this invention by providing a device in which the isolated high voltage electrodes are formed as closed rings concentric to the needle electrodes and in surrounding relationship thereto, which rings are conductively connected with each other. By this means, a much better utilization of the total length of the electrodes under high voltage conditions is achieved.

Because of the equidistant arrangement of the high voltage electrodes in the form of a ring type electrode, it is possible to create an electric field over the whole circumference of the electrode; whereas, with known electrode arrangements, only small portions of the high voltage electrode are responsible for the field generation, while the remaining portion thereof only establishes practically useless incoherent electrical fields. Also, one achieves with such a construction a practically ideal field concentration which is even. With known arrangements, on the other hand, the electric field only spreads over small angular segments. The ionizer according to this invention therefor distinguishes itself by providing a field of high intensity over a wide radiation pattern.

For manufacturing the ring electrodes there are several possibilities. The most simple possibility would be to form them by a means of a single electric cable which extends from one needle electrode to the other. However, such an arrangement requires a splitting of the cable into two equal sides, each needle electrode being surrounded by semicircles of the cable which close up again after passing each needle electrode, or the cable must be continuously wound around each needle electrode, which naturally requires one and a half windings for each needle electrode. Therefore, a greater total length of cable is required for such arrangements. As a result, it has been found to be very advantageous to use ring electrodes in the form of small metallic shells, which shells can be arranged in a continuous row and interconnected by conductive strips, for example, so that a particularly wide sphere of action is achieved.

In the interest of economical production, it is a further advantage to join the shells with each other along their connecting line, e.g., by spot welding or other means and then apply a thin coat of isolating material by dip coating, fluidized bed or electrostatic powdercoating, or such other known methods, to join the thus prepared shells to a perforated plate of plastic polymer in such a way that the perforations of the plate are coaxial with the opening of the shells and that the plate at the same time serves as a carrier for the collector bar on which the needle electrodes are supported.

The use of a perforated plate having perforations coaxial to the shells has the effect that between the needle electrodes and the shells (ring electrodes) where will be a continuous draught of air, which is produced by the ion movement and which reduces the settling of dust in the space between the electrodes. In fact, this is a distinct advantage since the settling of dust on the electrodes tends to reduce the efficiency of the ionizer, due to a decrease of the resistivity of the insulator and a resulting loss of voltage. In this connection it has been found suitable to connect the shell openings on their end opposite to the radiation side of the ionizer with a common supply channel for compressed air. This eliminates any need for the normal manual cleaning process because any dust between the elctrodes can be blown off when required by a blast of compressed air. Also, this air flow creates the possibility that the ions will be given a further aimed movement towards the substrate to be discharged, through which the efficiency of the ionizer is further increased.

In one of several possible arrangements, the air supply channel can be made of an electrical conductor and therefore at the same time function as a collector bar for the needle electrodes.

These and other objects, features and advantages of the present invention will become more apparent from the following detailed description of the present invention when taken in conjunction with the accompanying drawings, in which.

Figure 1:
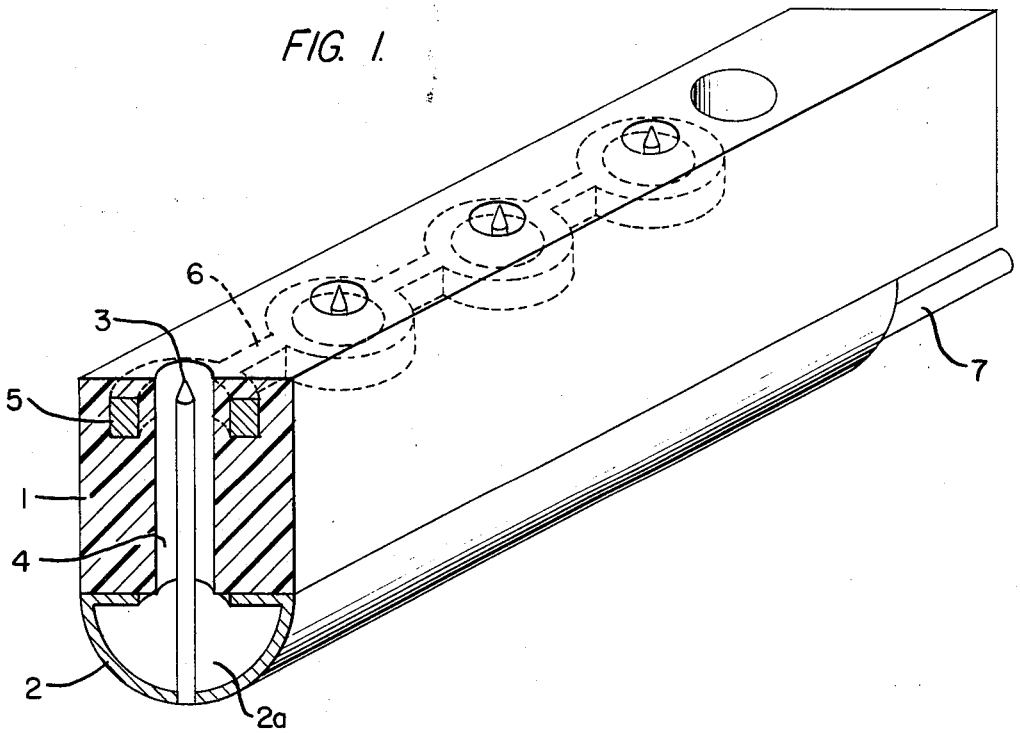
FIG. 1 is a perspective view partly in section of an ionizer in accordance with this invention.

The ionizer illustrated in FIG. 1 consists of an elongated insulator body 1 having a cover ledge 2 mounted on its underside. The cover ledge 2 is made of metal and functions as a collector bar for the plurality of needle electrodes 3 which are supported thereon. It can be glued to the insulator body or fastened to it by screws or any other suitable means, such as snap lock connection.

The insulator body 1 possesses drill holes 4 which are longitudinally spaced and disposed in coaxial relationship to the needle electrodes 3. These drill holes 4 have a diameter which is a few millimeters larger than the diameter of the needle electrodes 3. A few millimeters below its upper surface, a plurality of high voltage ring electrodes 5 are embedded in the insulator body 1 concentric to the needle electrodes 3. The connection of the ring electrodes 5 to each other is effected by connection pieces 6 which are also embedded in the insulator body 1.

The cover ledge 2 is closed at its respective ends to form a hollow chamber 2*a.* To a pipe of the chamber 2*a* is secured fitting 7 for the supply of air to the interior thereof and to provide an electrical ground connection at the same time to the needle electrodes 3. The air supplied under pressure to the chamber 2*a* passes through each of the drill holes 4 and serves to keep the passages between the needle electrodes 3 and the insulator body 1 free of dust as well as to aid in directing ions toward the substrate to be discharged.

Figure 2:
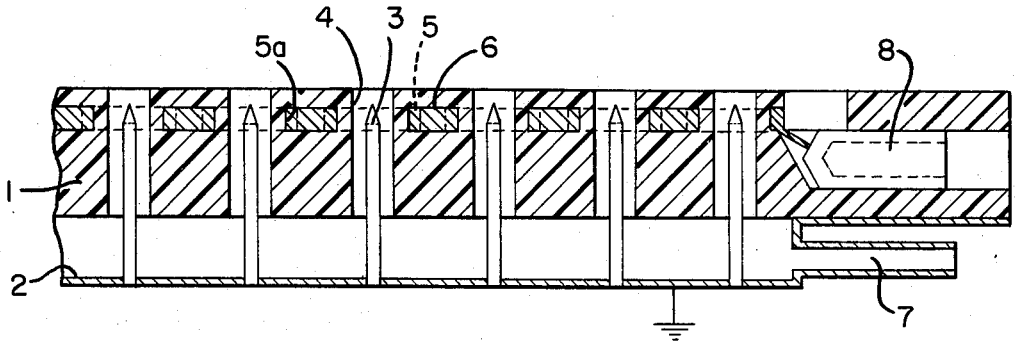
FIG. 2 is a longitudinal sectional view of a partly assembled ionizer.

FIG. 2 shows a longitudinal section through the insulator body 1 with the ring electrodes 5 and the connection pieces 6 not yet casted but just positioned in the appropriate drill openings 5*a.* Naturally, the ring electrodes 5 with their connection pieces 6 can be installed in the isolation body in any other suitable way. For example, the ring electrodes 5 and connection pieces 6 may be formed as an integral electrode which is precast in the insulator body 1 prior to drilling the holes 4.

FIG. 2 also shows the high voltage connection for the ring electrodes 5. It consists of a plug type connection 8 which is connected with the last ring electrodes 5 at one end of the insulator body 1. Of course, any other suitable means for connection of high voltage to the ring electrodes 5 will also be acceptable.

Figure 5:
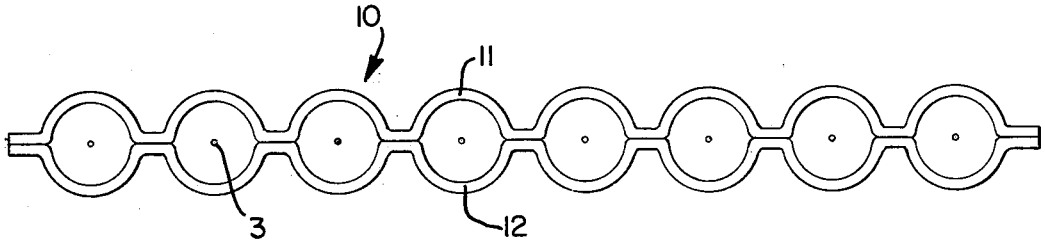
FIG. 5 is a plan view of one type of ring electrode arrangement formed of an electric cable.

In addition to being formed of metallic shells, as seen in FIGS. 1 and 2, the ring electrodes 5 and connection pieces 6 may be formed by a single electric cable, as seen in FIG. 5. In this arrangement, the cable 10 is split into two equal sides 11 and 12 each of which have distorted arcuate portions spaced along the length thereof which corporate to form rings 13 surrounding each of the needle electrodes. The cable 10 passes from one needle electrode to the other and is connected at one end to a high voltage connection 8.

Figure 6:
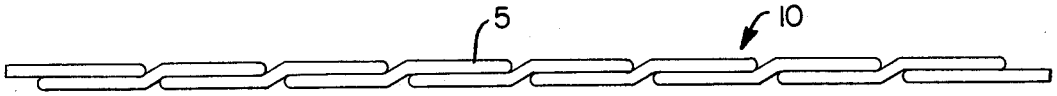
FIG. 6 is a side view of a second type of ring electrode arrangement formed of an electric cable.

FIG. 6 illustrates another arrangement for forming the ring electrodes from a single electric cable. In this arrangement, the cable 10 is wound around each needle electrode in turn as it extends from one needle electrode to the next.

Figure 3:
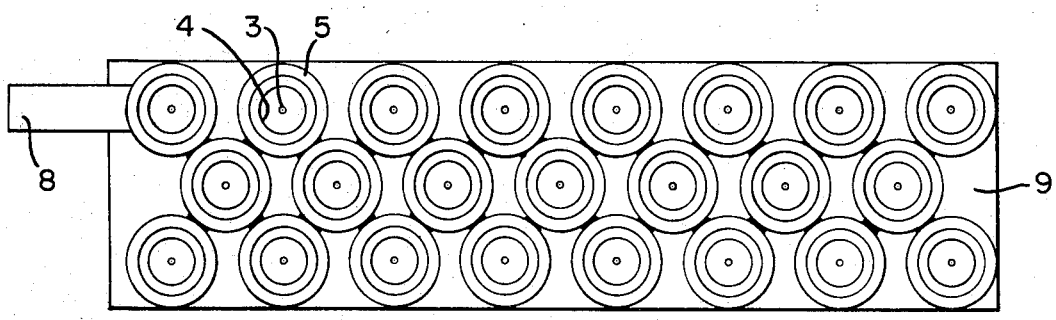
FIG. 3 is a top elevational view of an ionizer with multiple row arrangement of ring electrodes.
Figure 4:
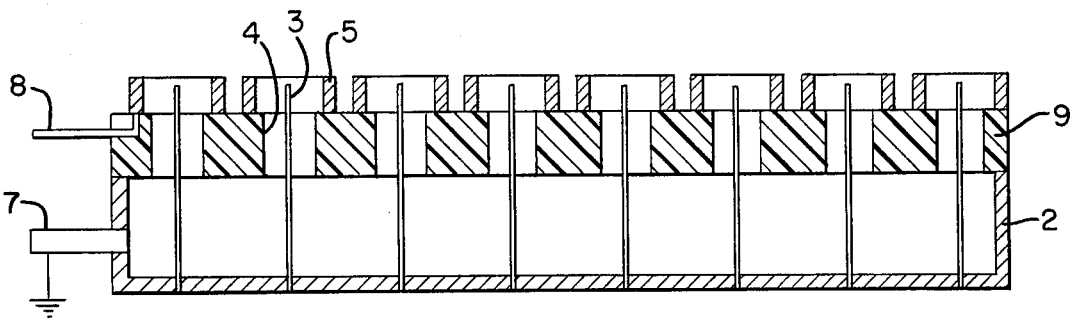
FIG. 4 is a longitudinal sectional view of an ionizer according to FIG. 3.

FIG. 3 shows a second embodiment of this invention having multiple row arrangement of the electrodes where all ring electrodes 5 are directly connected to each other, e.g., by spot welding. This serves to eliminate the connection pieces which were provided in the previous embodiment. After all ring electrodes are connected with each other, they are coated with an insulating material, which can be applied, for example, by dipping, fluidized bed process, electrostatic powder-coating, etc. They are then glued or otherwise bonded to a perforated plate 9, which also consists of plastic or other insulating material, as seen in FIG. 4. On the underside of the perforated plate 9, the cover ledge 2 is mounted in the way described above in connection with FIG. 1, which serves as a grounded collector bar and as a compressed air supply channel at the same time. The cover ledge 2 will preferably be of metallic material.

Summarizing the advantages of this invention, they are mainly that, under best utilization of the total electrode length, homogenic electric fields of great intensity and wide radiation pattern are received.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. A device for discharging static electricity by means of an electric glow discharge comprising a plurality of needle electrodes, first means for supporting said needle electrodes in spaced parallel relationship, a plurality of conductivity interconnected ring electrodes, second means for supporting said ring electrodes so that each ring electrode is positioned in coaxial surrounding relationship to a respective needle electrode, and means for effecting high voltage connection to said ring electrodes.

2. A device as defined in claim 1, wherein said ring electrodes are formed by a single cable leading from one needle electrode to the other.

3. A device as claimed in claim 2, wherein said cable is split into two equal sides having distorted portions of arcuate shape spaced along the length thereof which corporate rings surrounding each of the needle electrodes.

4. A device as defined in claim 2, wherein said cable is wound around each needle electrode in turn as it extends from one needle electrode to the next.

5. A device as defined in claim 1, wherein said ring electrodes are formed by cylindrical metallic shells.

6. A device as defined in claim 5, wherein said shells are arranged in at least one continuous row and are interconnected by metallic connection pieces.

7. A device as defined in claim 6, wherein said second means comprises an insulator bar having a plurality of through holes and in which said ring electrodes are embedded so as to be concentric with said through holes, said first means being mounted on said insulator bar with said needle electrodes extending into said through holes.

8. A device as defined in claim 7, wherein said first means is a hollow chamber the interior of which communicates with said through holes in said insulator bar and means for introducing air under pressure into said hollow chamber.

9. A device as defined in claim 1, wherein said ring electrodes are formed by cylindrical metallic shells disposed in a plurality of adjacent continuous rows and being in direct electrical contact with each other.

10. A device as defined in claim 1 wherein said second means comprises a perforated plate and said ring electrodes are coated with an insulating material and mounted on said plate so as to be coaxial with respective perforations in said plate, said first means being mounted on said plate with said needle electrodes extending into said perforations.

11. A device as defined in claim 10 wherein said first means is a hollow chamber the interior of which communicates with the perforations in said plate and means for introducing air under pressure into said hollow chamber.

12. A device as defined in claim 11 wherein said ring electrodes are formed by cylindrical metallic shells disposed in a plurality of adjacent continuous rows and being in direct electrical contact with each other.

13. A device as defined in claim 11 wherein said ring electrodes are formed by a single cable leading from one needle electrode to the other.

14. A device as defined in claim 1 wherein said second means comprises an insulator bar having a plurality of through holes and in which said ring electrodes are embedded so as to be concentric with said through holes, said first means being mounted on said insulator bar with said needle electrodes extending into said through holes.

15. A device as defined in claim 14 wherein said first means is a hollow chamber the interior of which communicates with said through holes in said insulator bar and means for introducing air under pressure into said hollow chamber.

* * * * *